US007770636B2

(12) United States Patent
Koh et al.

(10) Patent No.: US 7,770,636 B2
(45) Date of Patent: Aug. 10, 2010

(54) GROUNDWATER COLLECTING APPARATUS

(75) Inventors: Yong Kwon Koh, Daejeon (KR); Dae Seok Bae, Daejeon (KR); Jong Won Choi, Daejeon (KR)

(73) Assignees: Korea Atomic Energy Research Institute (KR); Korea Hydro & Nuclear Power Co.; Ltd. (KR)

( * ) Notice: Subject to any disclaimer, the term of this patent is extended or adjusted under 35 U.S.C. 154(b) by 134 days.

(21) Appl. No.: 11/838,089

(22) Filed: Aug. 13, 2007

(65) Prior Publication Data

US 2008/0149327 A1 Jun. 26, 2008

(30) Foreign Application Priority Data

Dec. 26, 2006 (KR) ..... 10-2006-0134125

(51) Int. Cl.
*E21B 43/00* (2006.01)
*E21B 33/12* (2006.01)

(52) U.S. Cl. ..... 166/105; 166/387

(58) Field of Classification Search ..... 166/105, 166/66.4, 387, 66.5, 75.11, 85.5
See application file for complete search history.

(56) References Cited

U.S. PATENT DOCUMENTS 2,729,171 A * 1/1956 Adams ..... 417/430
4,195,691 A * 4/1980 Newling ..... 166/378
6,419,011 B1 * 7/2002 Birckhead ..... 166/105
6,457,531 B1 * 10/2002 Bangash et al. ..... 166/369
6,962,204 B2 * 11/2005 Grubb et al. ..... 166/305.1
7,222,668 B2 * 5/2007 Belshaw et al. ..... 166/162
7,392,719 B2 * 7/2008 Lee et al. ..... 73/863.31
2004/0140087 A1 * 7/2004 Ferguson et al. ..... 166/68.5
2007/0114015 A1 * 5/2007 Shen ..... 166/105

FOREIGN PATENT DOCUMENTS

JP 09-025783 A 1/1997
JP 10-018749 A 1/1998
JP 2002-146851 A 5/2002

OTHER PUBLICATIONS

Office Action issued on Nov. 17, 2009 of corresponding Japanese Patent Application No. 2007-224113-3 pages.

* cited by examiner

*Primary Examiner*—David J Bagnell
*Assistant Examiner*—James G Sayre
(74) *Attorney, Agent, or Firm*—Knobbe Martens Olson & Bear LLP

(57) ABSTRACT

A groundwater collecting apparatus which can continuously collect groundwater, and can selectively collect groundwater at a specific depth by directly generating vertical movement is provided. The groundwater collecting apparatus includes: a vibration unit selectively admitting groundwater which exists in the monitoring well according to vibration in a vertical direction; a driving unit being supplied a power to vibrate the vibration unit in a vertical direction; and a hollow guide pipe being connected to the vibration unit to guide the groundwater to a ground, the groundwater having flowed into the vibration unit through a channel inlet of the vibration unit.

7 Claims, 6 Drawing Sheets

GROUNDWATER COLLECTING APPARATUS

CROSS-REFERENCE TO RELATED APPLICATION

This application claims the benefit of Korean Patent Application No. 10-2006-0134125, filed on Dec. 26, 2006, in the Korean Intellectual Property Office, the disclosure of which is incorporated herein by reference.

BACKGROUND OF THE INVENTION

1. Field of the Invention

The present invention relates to a groundwater collecting apparatus, and more particularly, to a groundwater collecting apparatus which can collect groundwater regardless of a size of a monitoring well and a collecting depth, and can selectively collect the groundwater at a specific depth.

2. Description of Related Art

Conventionally, various apparatuses are used to collect groundwater in a monitoring well. Referring to FIGS. 1 through 3, a configuration of a general groundwater collecting apparatus is described.

FIG. 1 is a configuration diagram illustrating a conventional groundwater collecting apparatus 10 using a lift pump 12, FIG. 2 is a configuration diagram illustrating a conventional groundwater collecting apparatus using an underwater pump 22, and FIG. 3 is a configuration diagram illustrating a conventional groundwater collecting apparatus using a conventional inertia pump 32.

The groundwater collecting apparatus 10 of FIG. 1 includes a guide pipe 18 and the lift pump 12. The guide pipe 18 is inserted into a monitoring well H, and is inserted to a level below a level L of groundwater. The lift pump 12 is formed on a ground portion of the guide pipe 18, and pumps groundwater from the monitoring well H.

The groundwater in the monitoring well H is guided to a ground along the guide pipe 18, by a suction force occurring in the lift pump 12.

A groundwater collecting apparatus 20 illustrated in FIG. 2 includes the underwater pump 22 and a guide pipe 28. The underwater pump 22 is formed on a level below a level L of groundwater which exists in a monitoring well H, and the guide pipe 28 is connected to the underwater pump 22 to guide pumped groundwater.

Accordingly, the groundwater in the monitoring well H is guided to a ground along the guide pipe 28, by a pumping force occurring in the underwater pump 22.

A groundwater collecting apparatus 30 illustrated in FIG. 3 includes the inertia pump 32 and a guide pipe 38. The inertia pump 32 is formed on a level below a level L of groundwater which exists in a monitoring well H, and the guide pipe 38 is connected to the inertia pump 32 to guide the groundwater.

In this instance, the inertia pump 32 includes a body part 34, an inertia ball 35 being formed inside the body part 34, and an upper stopper 36 being included in the body part 34. A channel hole is formed on a lower portion of the inertia pump 32 to admit the groundwater, and the inertia ball 35 is formed inside the body part 34.

The inertia ball 35 moves in a vertical direction inside the body part 34, and selectively covers the channel hole being formed in the body part 34. That is, when the body part 34 moves downward, the groundwater in the monitoring well H flows into the body part 34 through the channel hole, and when the body part 34 moves upward, the inertia ball 35 covers the channel hole. Accordingly, when vertical movement of the body part 34 is generated, the groundwater in the monitoring well H is pumped toward a ground.

However, the above described conventional groundwater collecting apparatuses have problems as follows:

In the groundwater collecting apparatus 10 of FIG. 1 using the lift pump 12, since the lift pump 12 has a limited suction force, there is a depth limit for groundwater to be lifted to a ground.

The underwater pump 22 of FIG. 2 can collect groundwater in a deeper location in comparison to the lift pump 12, however the underwater pump 22 has problems in that, as a depth increases, a capacity and a size of the underwater pump 22 is required to be greater, and more particularly, when a diameter of the monitoring well H is smaller, there is a limit to expand the capacity of the underwater pump 22.

Also, in a case of the inertia pump 32, limits for a collecting depth and a size of the monitoring well H are comparatively less, however the guide pipe 38 should be made of a robust material in order to transmit vertical movement on a ground to the inertia pump 32 being located in a corresponding collecting depth.

Also, there is a problem, in that the monitoring well H for groundwater may be destroyed since an inner wall of the monitoring well H is damaged due to vertical movement of the inertia pump 32.

BRIEF SUMMARY

An aspect of the present invention provides a groundwater collecting apparatus which can continuously collect groundwater regardless of a size of the monitoring well and a collecting depth.

An aspect of the present invention also provides a groundwater collecting apparatus which can selectively collect groundwater at a specific range of a collecting depth.

According to an aspect of the present invention, there is provided a groundwater collecting apparatus including: a vibration unit selectively admitting groundwater which exists in the monitoring well according to vibration in a vertical direction; a driving unit being supplied a power to vibrate the vibration unit in a vertical direction; and a hollow guide pipe being connected to the vibration unit to guide the groundwater to a ground, the groundwater having flowed into the vibration unit through a channel inlet of the vibration unit.

In an aspect of the present invention, the vibration unit may include a channel hole being formed on a lower portion of the vibration unit, and an inertia ball being movably formed in a vertical direction inside the vibration unit, and selectively covering the channel hole. In order to limit upward movement of the inertia ball, an upper portion of the vibration unit may be formed to be less than a diameter of the inertia ball.

Descending speed by the inertia ball's gown weight may be less than movement speed toward a lower portion of the vibration unit.

The driving unit may include a driving part being supplied the power to move the vibration unit in a single direction, and an elastic part moving the vibration unit in another direction using an elastic force.

In an aspect of the present invention, the driving part may be an electromagnet with coil windings in a cylindrical shape, and a part of the vibration unit is made of a magnetic material which reacts to the electromagnet. Also, the vibration unit may be elastically connected to the elastic part.

A part of the vibration unit may be inserted inside the driving part.

A groundwater collecting apparatus according to the present invention may further include an assistant pipe being formed on a surface of the vibration unit, and having a plurality of holes on a surface of the assistant pipe to admit in the groundwater, and a pair of packers being formed on surfaces of the guide pipe and the assistant pipe, and being selectively closely contacted to the inside of the monitoring well.

A volume of the pair of packers expands by compressed air from an outside so that the expanded pair of packers are contacted to the inside of the monitoring well.

Additional aspects, features, and/or advantages of the invention will be set forth in part in the description which follows and, in part, will be apparent from the description, or may be learned by practice of the invention.

BRIEF DESCRIPTION OF THE DRAWINGS

These and/or other aspects, features, and advantages of the invention will become apparent and more readily appreciated from the following description of exemplary embodiments, taken in conjunction with the accompanying drawings of which.

DETAILED DESCRIPTION OF EMBODIMENTS

Figure 1:
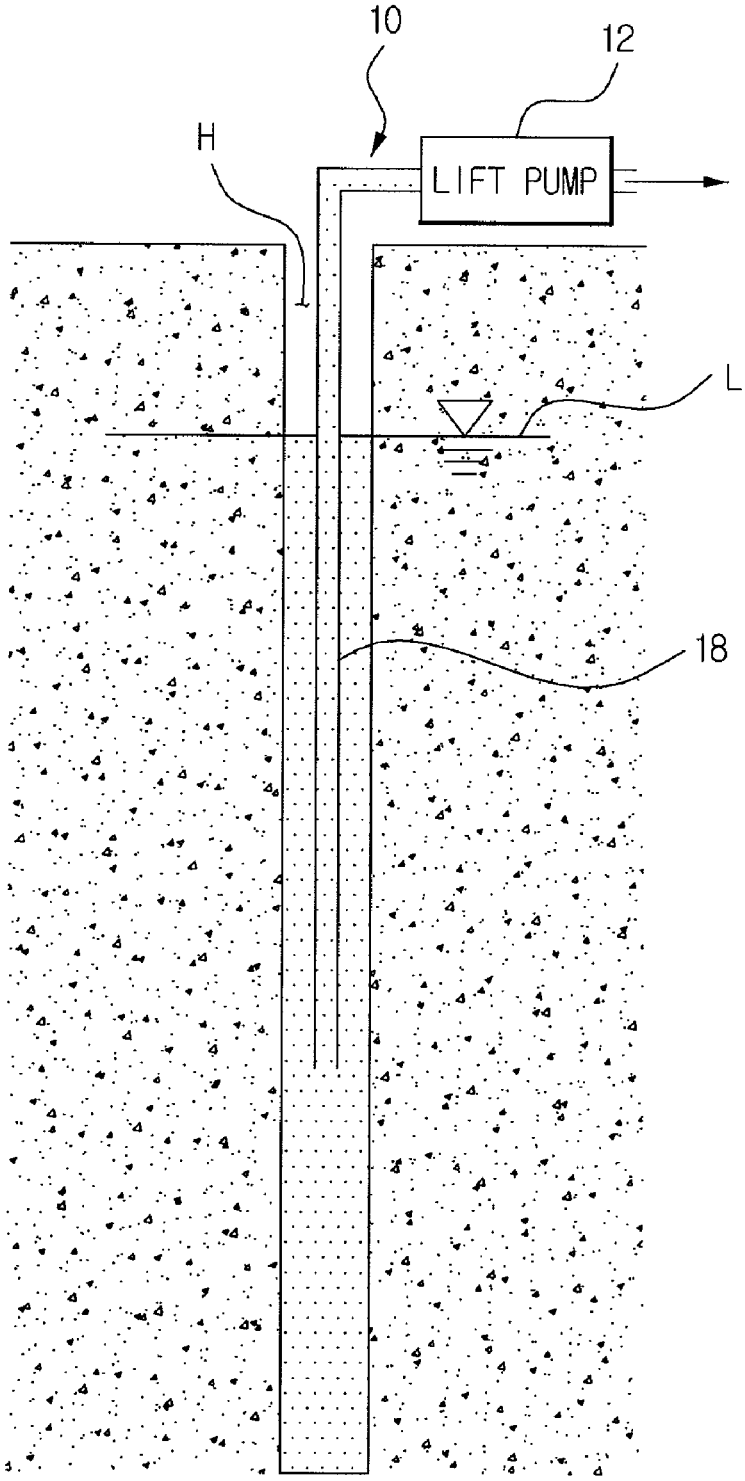
FIG. 1 (CONVENTIONAL ART)
FIG. 1 is a configuration diagram illustrating a conventional groundwater collecting apparatus using a lift pump.
Figure 2:
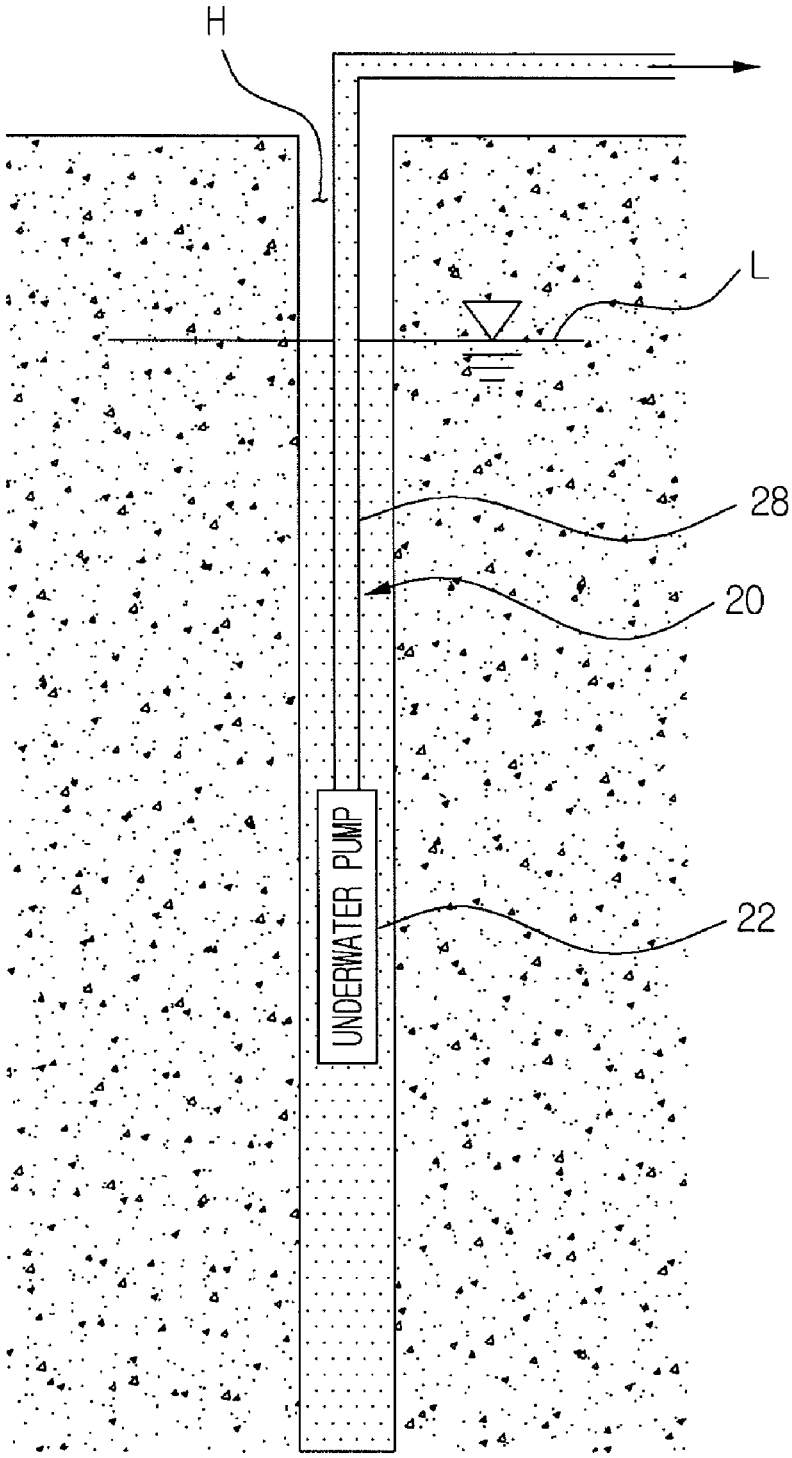
FIG. 2 (CONVENTIONAL ART)
FIG. 2 is a configuration diagram illustrating a conventional groundwater collecting apparatus using an underwater pump.
Figure 3:
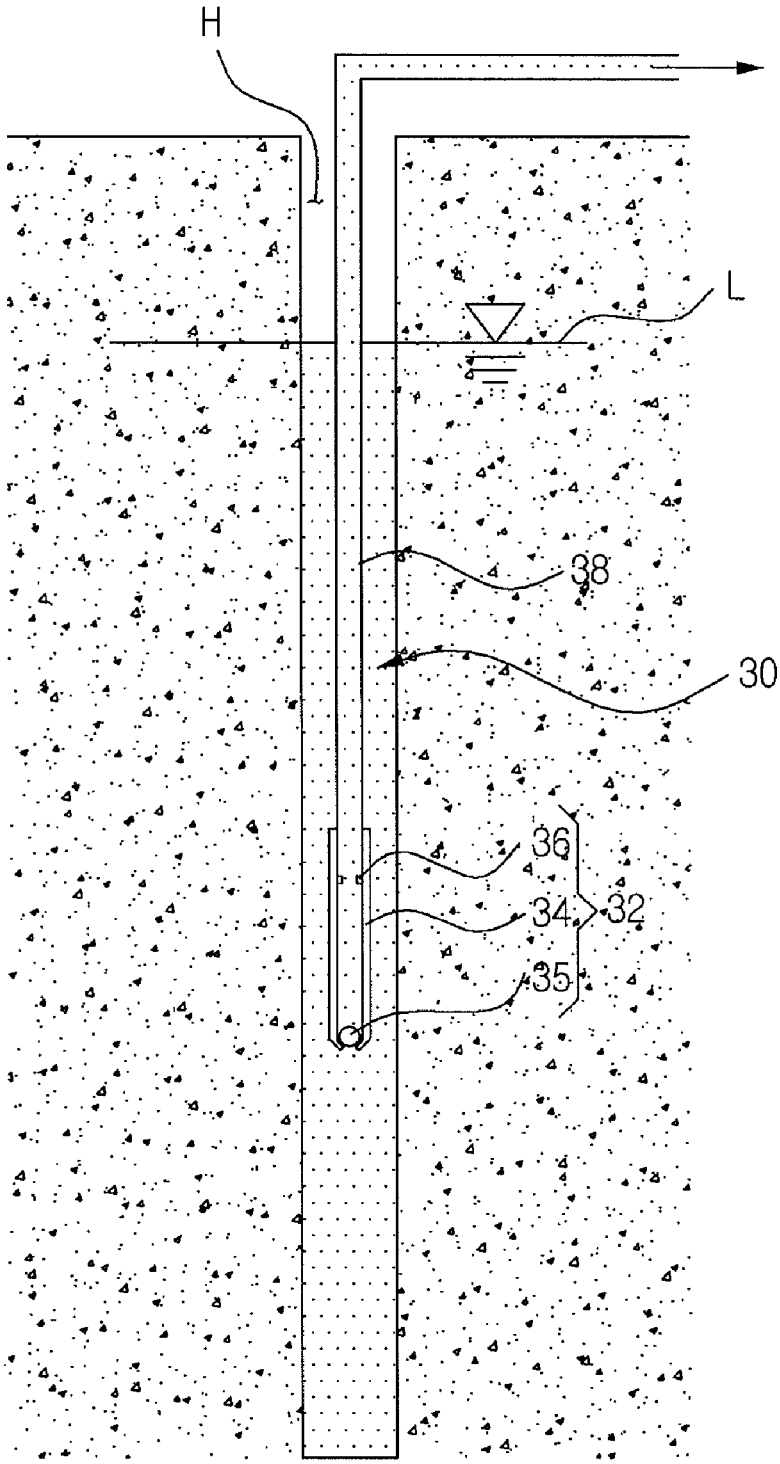
FIG. 3 (CONVENTIONAL ART)
FIG. 3 is a configuration diagram illustrating a conventional groundwater collecting apparatus using an inertia pump.

Reference will now be made in detail to exemplary embodiments of the present invention, examples of which are illustrated in the accompanying drawings, wherein like reference numerals refer to the like elements throughout. Exemplary embodiments are described below to explain the present invention by referring to the figures.

Hereinafter, a groundwater collecting apparatus according to a first embodiment of the present invention will be described by referring to FIGS. 4A and 4B.

The groundwater collecting apparatus according to the first embodiment of the present invention is inserted into a monitoring well H to collect groundwater, and includes a vibration unit 110, a driving unit 130, and a hollow guide pipe 150.

The vibration unit 110 selectively admits groundwater which exists in the monitoring well H according to vibration in a vertical direction, and includes a channel inlet 115, a first body part 117, and a second body part 119.

Figures 4A, 4B:
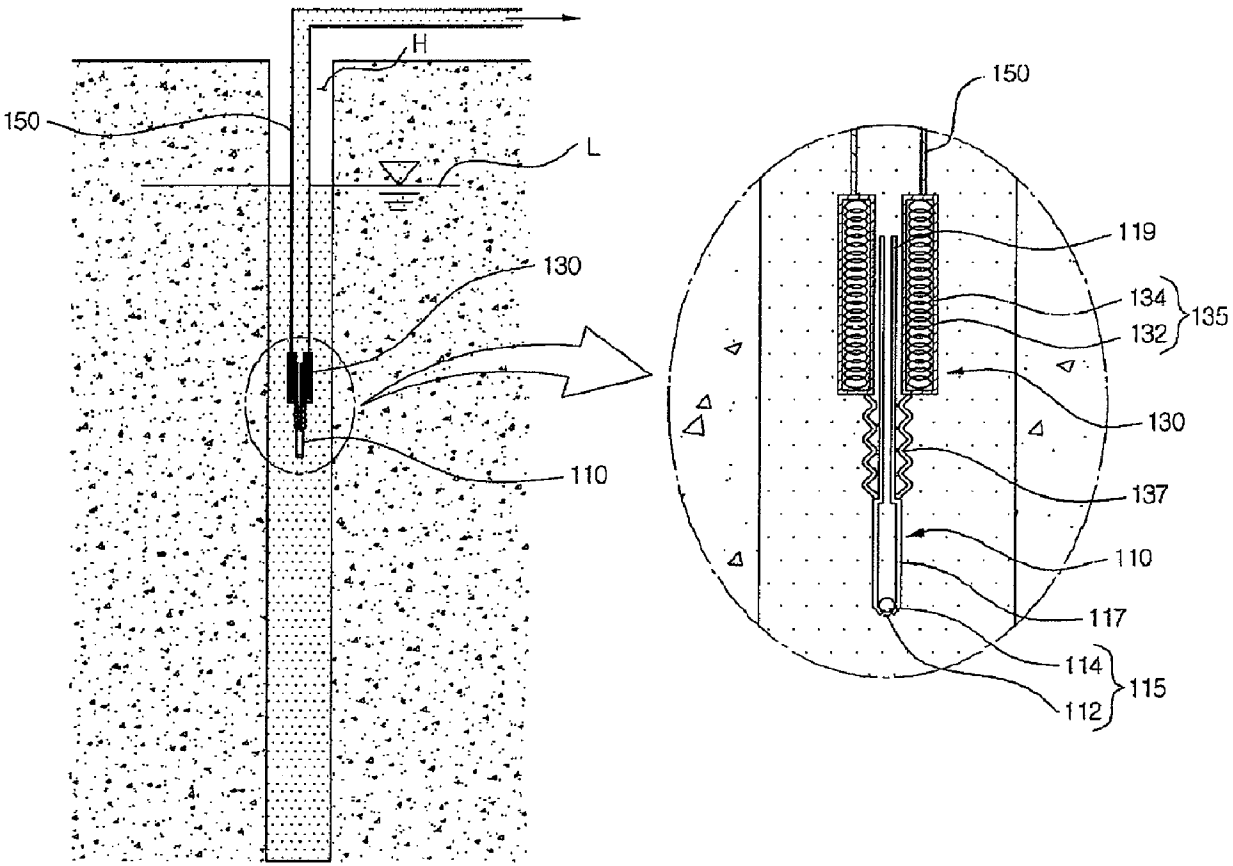
FIG. 4A is a diagram illustrating a groundwater collecting apparatus according to a first embodiment of the present invention.
FIG. 4B is an enlarged view of a portion of the groundwater collecting apparatus of FIG. 4A.

The channel inlet 115 selectively prevents the groundwater from flowing into an inside of the vibration unit 110, as illustrated in FIGS. 4A and 4B, and includes a channel hole 112 being formed on a lower portion of the vibration unit 110 and an inertia ball 114 being movably formed inside the vibration unit 110 in the first embodiment of the present invention.

In this instance, a diameter of the inertia ball 114 is formed to be greater than a diameter of the channel hole 112 so as to selectively cover the channel hole 112.

In the first embodiment of the present invention, the first body part 117 and the second body part 119 are integrally formed in a single body. As illustrated in FIGS. 4A and 4B, a diameter of the first body part 117 is formed to be slightly greater than a diameter of the inertia ball 114 so that the inertia ball 114 moves in a vertical direction. A diameter of the second body part 119 is formed to be less than the diameter of the inertia ball 114 so that the inertia ball 114 moves in a vertical direction within an inside of the first body part 117.

The driving unit 130 is supplied a power to vibrate the vibration unit 110 in a vertical direction.

In the first embodiment of the present invention, as illustrated in FIGS. 4A and 4B, the driving unit 130 includes a driving part 135 and an elastic part 137. The driving part 135 is supplied a power to move the vibration unit 110 in a single direction and the elastic part 137 moves the vibration unit 110 in another direction using an elastic force.

Specifically, in the first embodiment of the present invention, the vibration unit 110 moves upward by the driving part 135, and moves downward by the elastic part 137.

In this instance, the driving part 135 may be variously configured. In the first embodiment of the present invention, the driving part 135 moves the vibration unit 110 wherein the vibration unit 110 is in a solenoid shape. As illustrated in FIGS. 4A and 4B, an electromagnet 132 with coil winding in a cylindrical shape is formed inside a housing 134, and the vibration unit 110 is configured to move upward since the vibration unit 110 is made of a magnetic material which reacts to the electromagnet 132.

In the first embodiment of the present invention, the vibration unit 110 is inserted inside the driving part 135, and vertically vibrates inside the driving part 135.

The elastic part 137 elastically connects the vibration unit 110 and the housing 134 so that the vibration unit 110 may return downward when a power of the driving part 135 is released.

The elastic part 137 is illustrated in a bellows shape in FIGS. 4A and 4B, however the elastic part 137 may be configured in various shapes such as a general coil spring shape.

The power being supplied to the driving part 135 is alternatingly turned on-off, the vibration unit 110 moves upward by the electromagnet 132 of the driving part 135 when the power is supplied to the driving part 135, and the vibration unit 110 moves downward by a restoring force of the elastic part 137 when the power is turned off.

An amount of the groundwater to be collected may be controlled by changing a period of the power being supplied to the driving part 135 and changing a size of the vibration unit 110.

A wire may be provided inside the guide pipe of the driving part 135 so that an external power may be supplied to the driving part 135.

The hollow guide pipe 150 is connected to the vibration unit 110 in an upper portion of the vibration unit 110, and guides the groundwater to a ground, the groundwater having flowed into the vibration unit 110 through the channel inlet 115 of the vibration unit 110.

Hereinafter, operations of the groundwater collecting apparatus of FIGS. 4A and 4B will be described by referring to FIGS. 5A and 5B.

As described with reference to a first operation of the groundwater collecting apparatus of FIGS. 5A and 5B, a vibration unit 110 vibrates in a vertical direction by an attractive force of a driving part 135 and a restoring force of an elastic part 137.

As illustrated in a first operation of the groundwater collecting apparatus of FIG. 5, when a power being supplied to the driving part 135 is released, the vibration unit 110 moves downward by the restoring force of the elastic part 137.

Figure 5A:
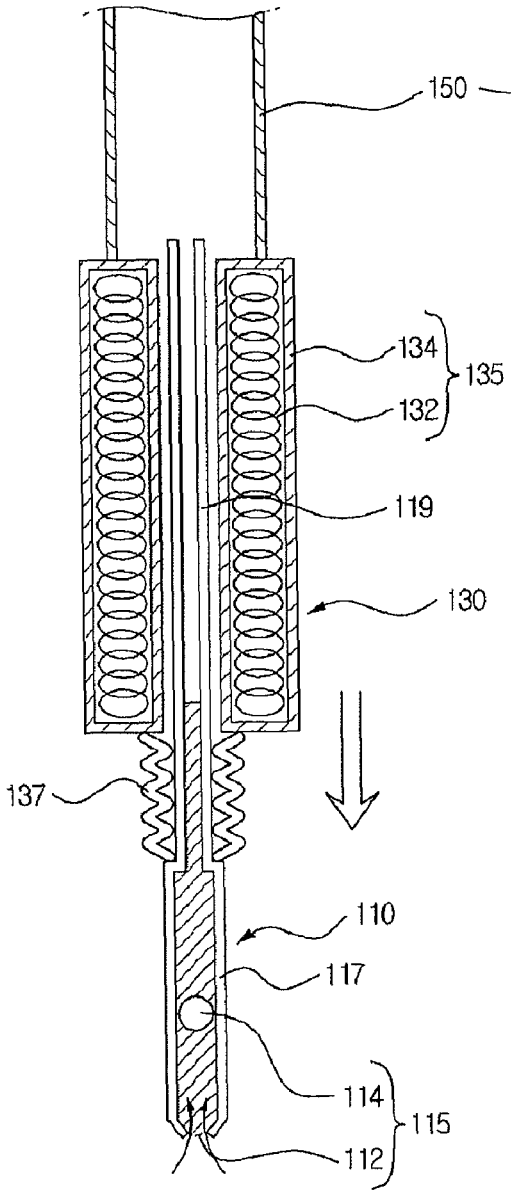
FIGS. 5A and 5B are diagrams illustrating operations of the groundwater collecting apparatus of FIGS. 4A and 4B.
Figure 5B:
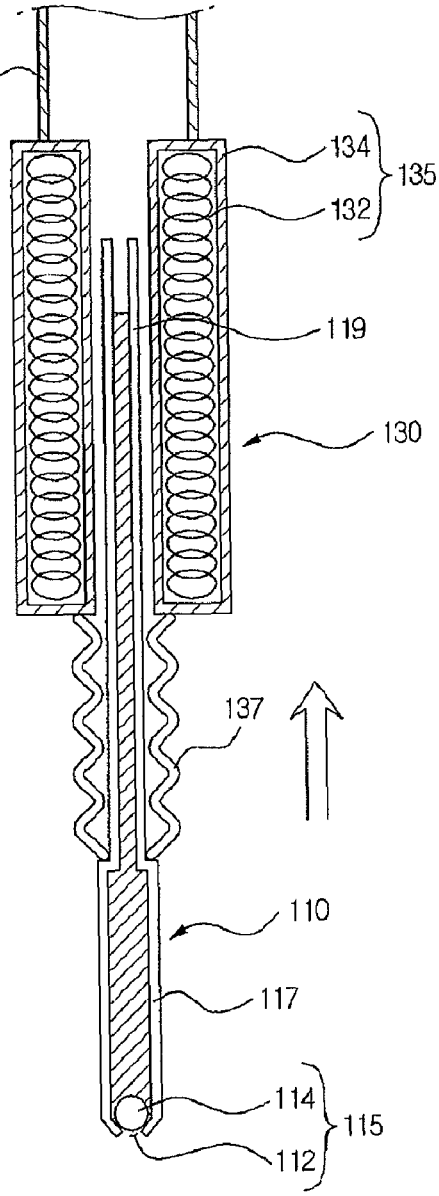

In this instance, due to the restoring force of the elastic part 137, when the vibration unit 110 moves downward faster than descending speed due to the inertia ball's 114 own weight, as illustrated in the first operation of the groundwater collecting apparatus of FIGS. 5A and 5B, the level of the inertia ball 114 becomes relatively higher inside the vibration unit 110, consequently a channel hole 112 of a lower portion of the vibration unit 110 becomes open.

Accordingly, groundwater in a monitoring well H flows into the vibration unit 110 through the channel hole 112.

As illustrated in a second operation of the groundwater collecting apparatus of FIGS. 5A and 5B, the vibration unit 110, having moved downward, moves upward by the driving part 135 being supplied a power.

Specifically, when the power is supplied to an electromagnet 132 of the driving part 135, the vibration unit 110, which is made of a magnetic material, moves upward by a magnetic field occurring in the electromagnet 132.

In this instance, the inertia ball 114 covers the channel hole 112 to prevent the groundwater from discharging back through the channel hole 112, and guides the groundwater along the guide pipe 150, the groundwater having been flowed into the vibration unit 110.

Figure 6B:
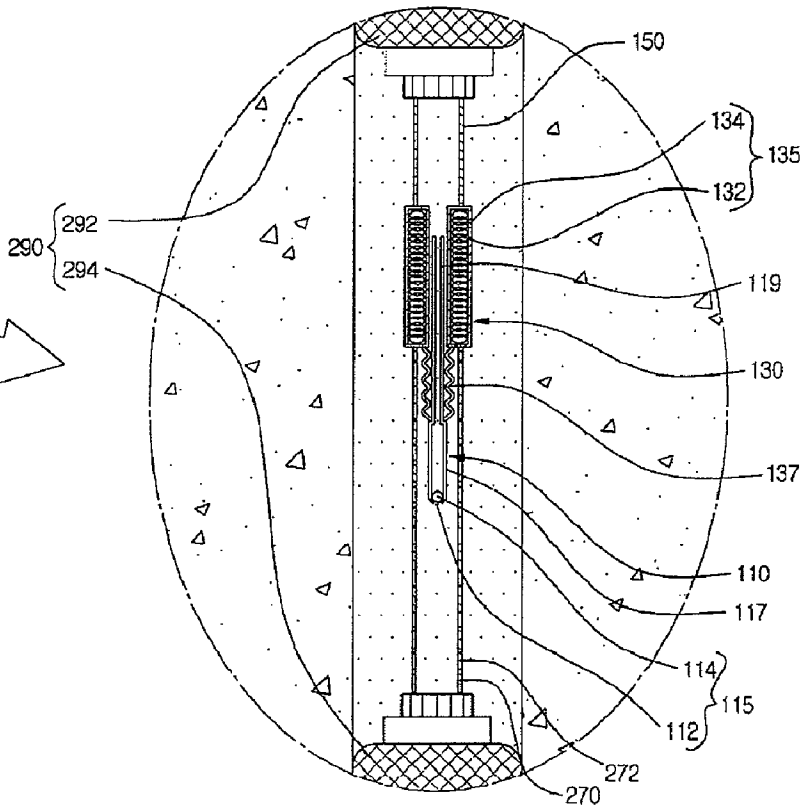
FIG. 6B is an enlarged view of a portion of the groundwater collecting apparatus of FIG. 6A.
Figure 6A:
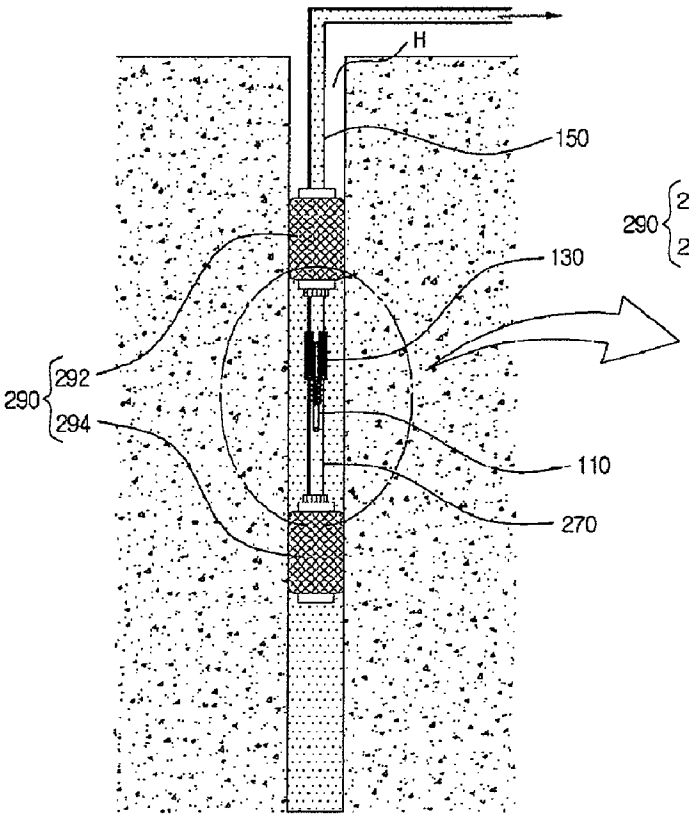
FIG. 6A is a diagram illustrating a groundwater collecting apparatus according to a second embodiment of the present invention.

Hereinafter, a groundwater collecting apparatus according to a second embodiment of the present invention will be described by referring to FIGS. 6A and 6B.

A basic configuration of the groundwater collecting apparatus according to the second embodiment of the present invention is identical to the configuration of the groundwater collecting apparatus according to the first embodiment of the present invention, however the water collecting apparatus according to the second embodiment of the present invention further includes a pair of packers 290 capable of drawing groundwater from a specific depth.

The pair of packers 290 includes an upper packer 292 being formed on an upper portion of the pair of packers 290 and a lower packer 294 being formed on a lower portion of the pair of packers 290, and is closely contacted to an inside of a monitoring well H.

The pair of packers 290 may be contacted to the inside of the monitoring well in various shapes, in the second embodiment of the present invention, a volume of the pair of packers 290 expands by compressed air from an outside so that the expanded pair of packers 290 are contacted to the inside of the monitoring well H.

In the second embodiment of the present invention, an assistant pipe 270 is formed on a surface of a vibration unit 110 which corresponds to a guide pipe 150. The upper packer 292 is formed on a surface of the guide pipe 150, and the lower packer is formed on a surface of the assistant pipe 270.

In the second embodiment of the present invention, a plurality of holes 272 are formed on the surface of the assistant pipe 270 so that groundwater may be flowed into the inside of the vibration unit 110

As described above, since the pair of packers 290 are closely contacted to the inside of the monitoring well H, a specific portion of the monitoring well H becomes separated from other portions of the monitoring well H, groundwater at a specific depth ranging between the upper packer 292 and the lower packer 294 may be selectively collected.

Hereto, the groundwater collecting apparatus is described as an example in the specification of the present invention, however the present invention is not limited to the above described embodiments, and also may be applicable to various fluids, including the groundwater.

According to the above-described exemplary embodiments of the present invention, a groundwater collecting apparatus may continuously collect groundwater regardless of a size of a monitoring well since a vibration unit is vibrated underwater, not on a ground, and movement is performed in a vertical direction.

Also, according to the above-described exemplary embodiments of the present invention, a groundwater collecting apparatus may effectively collect groundwater using a simple structure since a vibration unit is vibrated in a vertical direction by an electromagnet and an elastic member, and the groundwater may be pumped.

Also, according to the above-described exemplary embodiments of the present invention, a groundwater collecting apparatus may measure various components of groundwater on the spot without contacting air while continuously collecting the groundwater.

Also, according to the above-described exemplary embodiments of the present invention, a groundwater collecting apparatus may selectively collect groundwater at a specific depth since an upper packer and a lower packer are provided in the groundwater collecting apparatus.

That is, groundwater at a specific depth ranging between the upper packer and the lower packer may be selectively collected since a vibration unit vibrates in a vertical direction under water, and the upper packer and the lower packer are respectively formed on an upper portion and a lower portion of the vibration unit.

Although a few exemplary embodiments of the present invention have been shown and described, the present invention is not limited to the described exemplary embodiments. Instead, it would be appreciated by those skilled in the art that changes may be made to these exemplary embodiments without departing from the principles and spirit of the invention, the scope of which is defined by the claims and their equivalents.

What is claimed is:

1. A groundwater collecting apparatus inserted in a monitoring well for collecting groundwater, the apparatus comprising:

a vibration unit selectively admitting groundwater which exists in the monitoring well according to vibration in a vertical direction wherein the vibration unit comprises a channel hole being formed on a lower portion of the vibration unit and an inertia ball being movably formed in a vertical direction inside the vibration unit and selectively covering the hole;

a driving unit being supplied a power to vibrate the vibration unit in a vertical direction;

a hollow guide pipe being connected to the vibration unit to guide the groundwater to a ground, the groundwater having flowed into the vibration unit through a channel inlet of the vibration unit;

an assistant pipe being formed outside of the vibration unit, and having a plurality of holes on a surface of the assistant pipe to admit the ground water; and a pair of packers being formed on surfaces of the hollow guide pipe and the assistant pipe, and being selectively and closely contacted to an inside of the monitoring well, wherein the vibration unit is positioned between the packers.

2. The apparatus of claim 1, wherein an upper portion of the vibration unit is formed to be less than a diameter of the inertia ball so that the inertia ball is limited in movement in an upwards direction.

3. The apparatus of claim 1, wherein descending speed by the inertia ball's own weight is less than movement speed toward a lower portion of the vibration unit.

4. The apparatus of claim 1, wherein the driving unit comprises:

a driving part being supplied the power to move the vibration unit in a single direction; and an elastic part moving the vibration unit in another direction using an elastic force.

5. The apparatus of claim 4, wherein the driving part is an electromagnet with coil windings in a cylindrical shape, and a part of the vibration unit is made of a magnetic material which reacts to the electromagnet.

6. The apparatus of claim 4, wherein the vibration unit is elastically connected to the elastic part.

7. The apparatus of claim 4, wherein a part of the vibration unit is inserted inside the driving part.

* * * * *